US009282767B1

(12) United States Patent
Sinclair, Jr.

(10) Patent No.: US 9,282,767 B1
(45) Date of Patent: Mar. 15, 2016

(54) SMOKING ARTICLE AND METHOD

(71) Applicant: Blunt Wrap U.S.A., Inc., Mandeville, LA (US)

(72) Inventor: Daniel S. Sinclair, Jr., Mandeville, LA (US)

(73) Assignee: Blunt Wrap U.S.A., Inc., Mandeville, LA (US)

( * ) Notice: Subject to any disclaimer, the term of this patent is extended or adjusted under 35 U.S.C. 154(b) by 511 days.

(21) Appl. No.: 13/795,239

(22) Filed: Mar. 12, 2013

Related U.S. Application Data

(63) Continuation of application No. 12/510,581, filed on Jul. 28, 2009, now Pat. No. 8,393,335.

(60) Provisional application No. 61/086,643, filed on Aug. 6, 2008.

(51) Int. Cl.
*A24D 1/02* (2006.01)
*A24D 1/04* (2006.01)

(52) U.S. Cl.
CPC . *A24D 1/02* (2013.01); *A24D 1/042* (2013.01)

(58) Field of Classification Search
None
See application file for complete search history.

(56) References Cited

U.S. PATENT DOCUMENTS

| | | | |
|---|---|---|---|
| 191,501 | A | 5/1877 | Willis |
| 200,889 | A | 3/1878 | Bishop |
| 304,582 | A | 9/1884 | Thoss |
| 389,975 | A | 9/1888 | Riedel |
| 657,403 | A | 9/1900 | Brul |
| 663,073 | A | 12/1900 | Coughtry |
| 725,671 | A | 4/1903 | Butler |
| 1,104,779 | A | 7/1914 | Cooley |
| 1,223,362 | A | 4/1917 | Bock |
| 1,479,458 | A | 1/1924 | Mota |
| 3,385,302 | A | 5/1968 | Wattenford |
| 3,580,433 | A | 5/1971 | Kastner |
| 4,047,535 | A | 9/1977 | Wimmer |
| 4,452,257 | A | 6/1984 | Cartwright et al. |
| 4,726,473 | A | 2/1988 | Sato et al. |
| 5,133,366 | A | 7/1992 | Liebich |
| 5,147,463 | A | 9/1992 | Eilerman et al. |
| 5,464,073 | A | 11/1995 | Johannes |
| 5,645,089 | A | 7/1997 | Burger et al. |
| 5,762,074 | A | 6/1998 | Garner |
| 5,782,246 | A | 7/1998 | Axelrod |
| 6,153,233 | A | 11/2000 | Gordon et al. |
| 6,164,443 | A | 12/2000 | Mitchell et al. |
| 6,321,755 | B1 | 11/2001 | Sinclair, Jr. |
| 6,357,448 | B1 | 3/2002 | Sinclair, Jr. |
| 6,526,986 | B1 | 3/2003 | Sinclair, Jr. |

(Continued)

FOREIGN PATENT DOCUMENTS

| | | |
|---|---|---|
| DE | 352277 | 4/1922 |
| GB | 1230576 | 5/1971 |

*Primary Examiner* — Michael J Felton
(74) *Attorney, Agent, or Firm* — Garvey, Smith, Nehrbass & North, LLC; Brett A. North

(57) ABSTRACT

A smoking article provides one or more sheets of material that can be rolled to a tube or shell or tube-like shape and then packaged in an unfilled or partially filled condition, one end portion of the tube or shell or tube-like shape being at least partially closed. In one embodiment, multiple sheets are rolled layers that can optionally be wrapped around a form casing (or pre-rolled inside) and then packaged with one end closed or partially closed. In another embodiment, a rod that assists in loading tobacco into the shell cavity is provided. In one embodiment, the plug takes the form of a mouthpiece.

18 Claims, 7 Drawing Sheets

(56) References Cited

U.S. PATENT DOCUMENTS

| | | | |
|---|---|---|---|
| 6,742,525 | B2 | 6/2004 | Sinclair, Jr. |
| 6,854,471 | B1 | 2/2005 | Sinclair, Jr. |
| 7,377,281 | B2 | 5/2008 | Bachmann |
| 7,543,590 | B2 | 6/2009 | Sinclair, Jr. et al. |
| 7,571,730 | B2 | 8/2009 | Sinclair, Jr. |
| 7,604,008 | B2 | 10/2009 | Gomez |
| 2002/0166561 | A1 | 11/2002 | Sinclair, Jr. |
| 2005/0072439 | A1 | 4/2005 | Darwish |
| 2005/0121341 | A1 | 6/2005 | Darwish |
| 2007/0095359 | A1 | 5/2007 | Kang et al. |

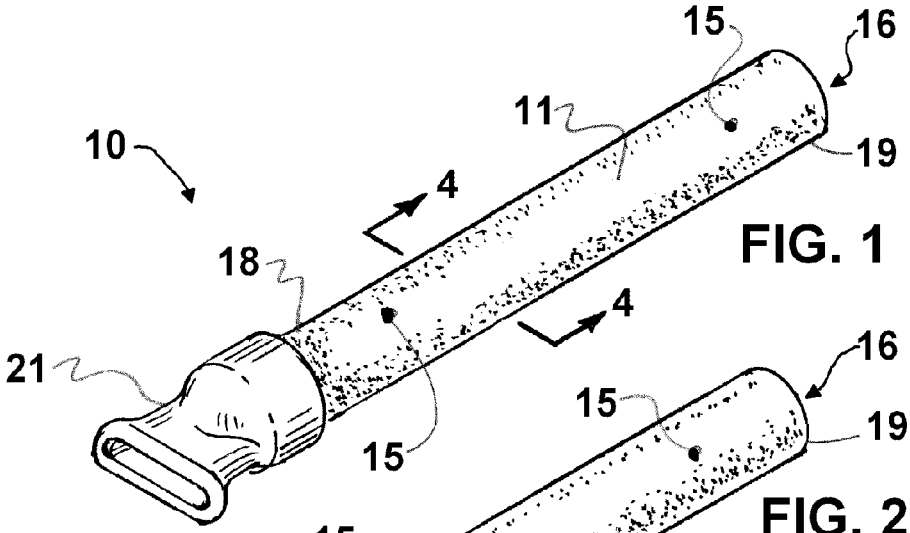
FIG. 1
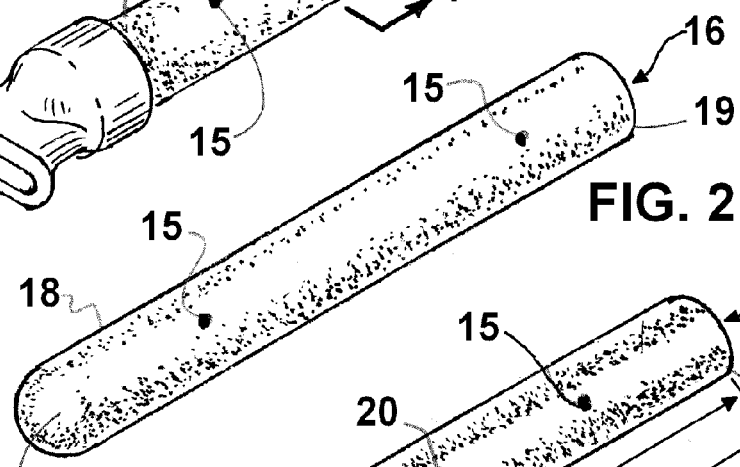
FIG. 2
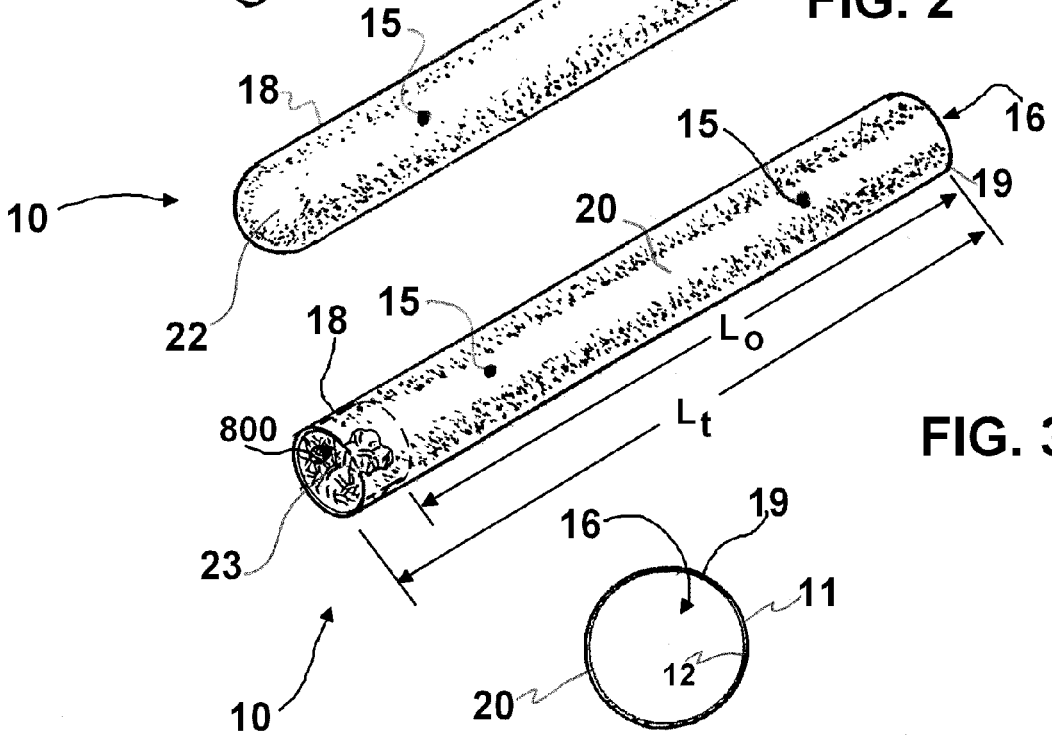
FIG. 3
FIG. 4

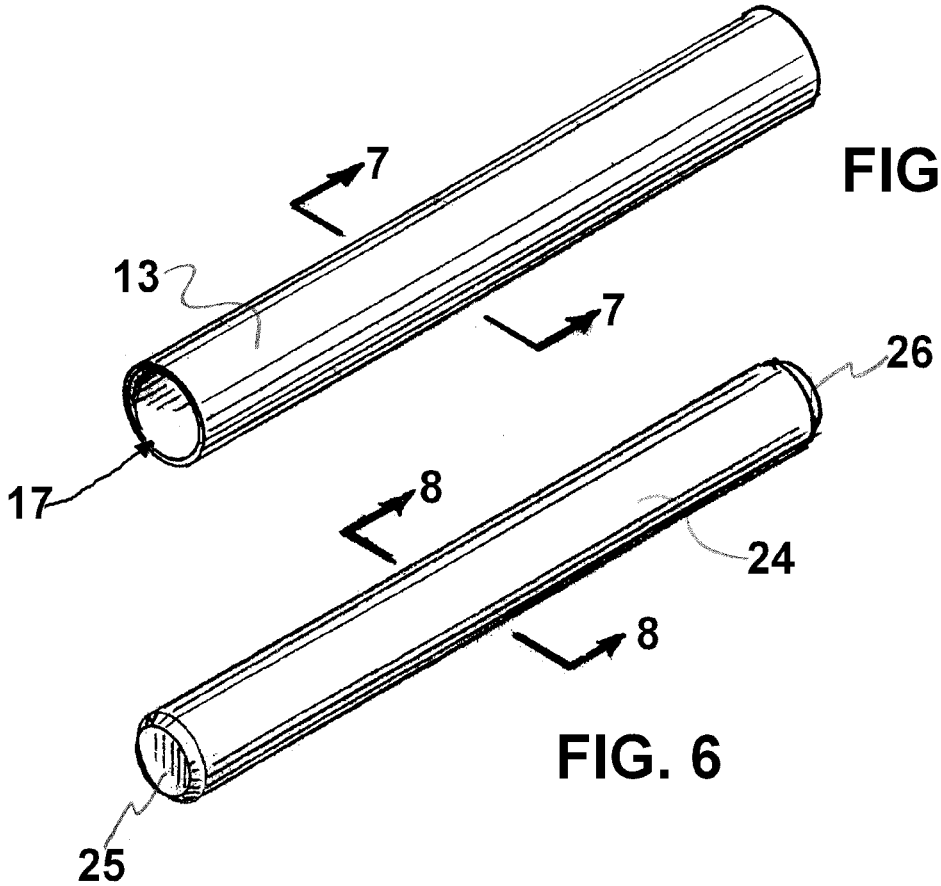
FIG. 5
FIG. 6
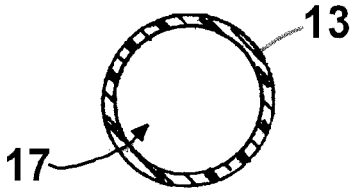
FIG. 7
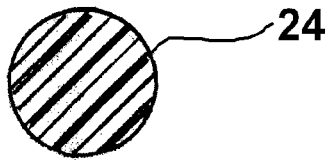
FIG. 8

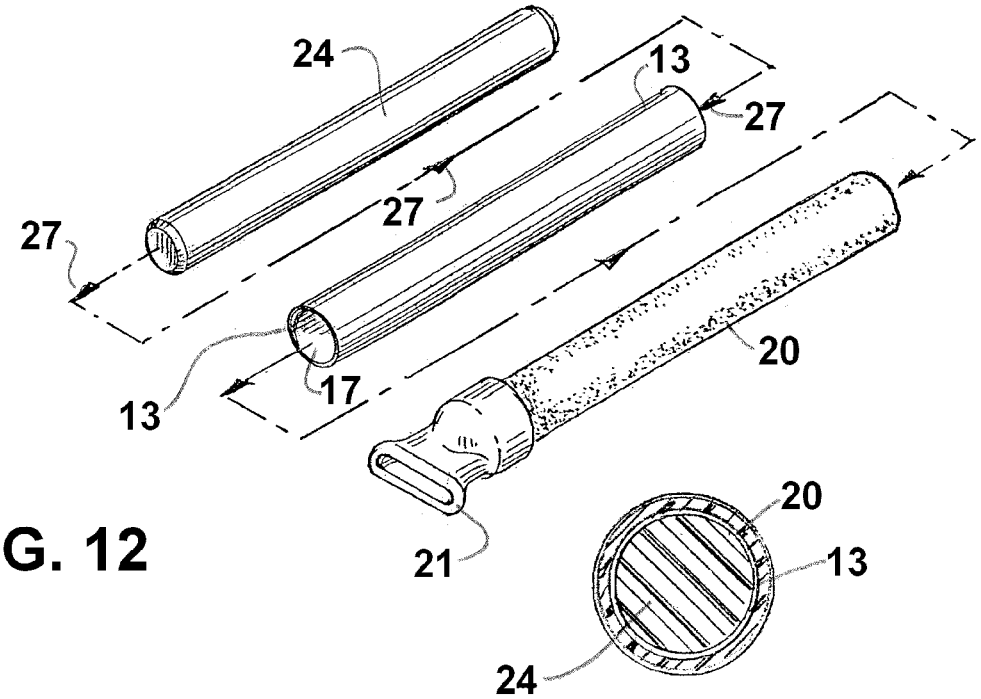
FIG. 12
FIG. 13
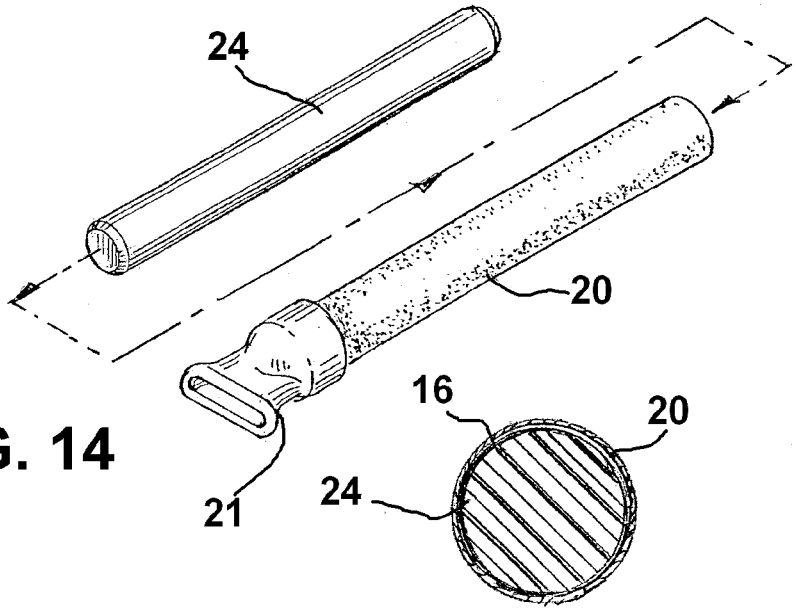
FIG. 14
FIG. 15

SMOKING ARTICLE AND METHOD

CROSS-REFERENCE TO RELATED APPLICATIONS

This is a continuation of U.S. patent application Ser. No. 12/510,581, filed Jul. 28, 2009 (now U.S. Pat. No. 8,393,335), which was a non-provisional of U.S. provisional patent application Ser. No. 61/086,643, filed Aug. 6, 2008. Both applications are incorporated herein by reference and priority of each is hereby claimed.

U.S. provisional patent application Ser. No. 60/870,490, filed Dec. 18, 2006, is incorporated herein by reference.

U.S. patent application Ser. No. 11/139,432, filed May 27, 2005, is incorporated herein by reference.

U.S. provisional patent application Ser. No. 60/915,994, filed May 4, 2007, is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND

1. Field

The present invention relates to cigars and like smoking articles. More particularly, the present invention relates to a smoking article that is a shell or tube with a bore, cavity or internal void space that is closed or partially closed at one end and packaged in an unfilled or partially filled condition, affording a consumer with an opportunity to fill the shell with his or her own custom tobacco, one end of the unfilled shell or tube being at least partially closed.

2. General Background

In recent years, smoking of cigars has become in vogue, and numerous cigar shops opened around the world to satisfy this growing trend. The variety, quality and size of ready-made cigars satisfy the majority of the public. However, a small segment of connoisseurs insist that nothing can compare with the taste and smell of custom-blended tobacco products. These knowledgeable individuals are very selective in the manner their cigars are rolled and in the grade of tobacco used.

A still smaller segment of cigar aficionados prefers to roll their own cigars. They buy tobacco leaves or cigar wrapping and use their preferred brand of crushed tobacco. Some people buy inexpensive cigars, cut them with a sharp blade along the side and carefully pry the cut cigar open. The innermost layers are then removed and substituted with a favorite brand of crushed tobacco, which may come from cigarettes or bulk tobacco blend. The user then brings the cut edges of the cigar together, closing the outer layers of the cigar over the stuffing of selected tobacco. The edges are then sealed with a liquid or honey, and a new cigar is ready for a smoke.

Some reports indicate that the "roll-your-own" tobacco market is flourishing. In some countries, the roll-your-own products now hold a substantial share of the tobacco market, and their consumers represent more than 10% of the smoking population. This may be explained by the ability of a consumer to create a tailor-made product, as opposed to commercially available types of cigars.

U.S. Pat. No. 2,091,598 is incorporated herein by reference. Flat clear sheets of cellulose rolling paper are conventionally available. Most conventionally available clear cellulose are made from a mixture of cellulose, glycerin, and water. Cellulose can come from wood, cotton, or other sources of cellulose. The process is similar to that used to make cellophane. Some clear sheets are made from 80 percent *Eucalyptus* based cellulose, 14 percent glycerin, and 6 percent water. Glycerin can be used to control the rate of burn of the clear cellulose sheets.

U.S. patent application Ser. Nos. 10/957,462; 11/139,432 and 60/915,994 are incorporated herein by reference.

BRIEF SUMMARY

The present invention provides an improved tobacco article that employs a sheet of material that is flexible so that it can be configured in a cylindrically shaped or tubular roll or shell having a cavity, void space or bore that enables containment of tobacco material such as a user's custom tobacco material. The tubular roll or shell can be formed of a single sheet or multiple sheets. At least one of the sheets includes some or all tobacco material.

A plug at least partially closes one end of the roll or shell. The plug can be in the form of a mouthpiece, a closed end of the shell that is a part of the shell itself, or a or insert that is added to one end of the shell such as for example a small volume of tobacco material or other material.

The sheet of material that provides the tubular shell can be sealed (such as with tobacco glue) so that it cannot be unrolled without damaging the sheet.

A package contains the sheet, the plug, and optionally a shape supportive form casing and/or a rod. The rod or casing can be used for loading and/or compacting tobacco material into the cavity, void space or bore.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 1 is a perspective view of the preferred embodiment of the article of the present invention wherein the closed end is in the form of a detachably connected mouthpiece.

FIG. 2 is a perspective view of an alternative shell where the closed end of the shell is of the same material as the shell.

FIG. 3 is a perspective view of another alternative shell where the closed end of the shell is closed with an insert or plug.

FIG. 4 is a sectional view taken along lines 4-4 of FIG. 1.

FIG. 5 is a perspective view of one embodiment of a form casing.

FIG. 6 is a perspective view of one embodiment of a packing or loading rod.

FIG. 7 is a sectional view taken along lines 7-7 of FIG. 5.

FIG. 8 is a sectional view taken along lines 8-8 of FIG. 6.

FIG. 12 is a perspective view of a kit embodiment incorporating the shell of FIG. 2 with the form casing of FIG. 5 and the packing or loading rod of FIG. 6 schematically indicating that each of them are combined in coaxial relationship and packaged for sale as a kit.

FIG. 13 is a sectional view illustrating the embodiment of FIG. 12 after being assembled.

FIG. 14 is a perspective view of a kit embodiment incorporating the shell of FIG. 2 with the packing or loading rod of FIG. 6 schematically indicating that the items are combined in coaxial relationship and packaged for sale as a kit.

FIG. 15 is a sectional view of the embodiment of FIG. 14 after being assembled.

DETAILED DESCRIPTION

Figure 9:
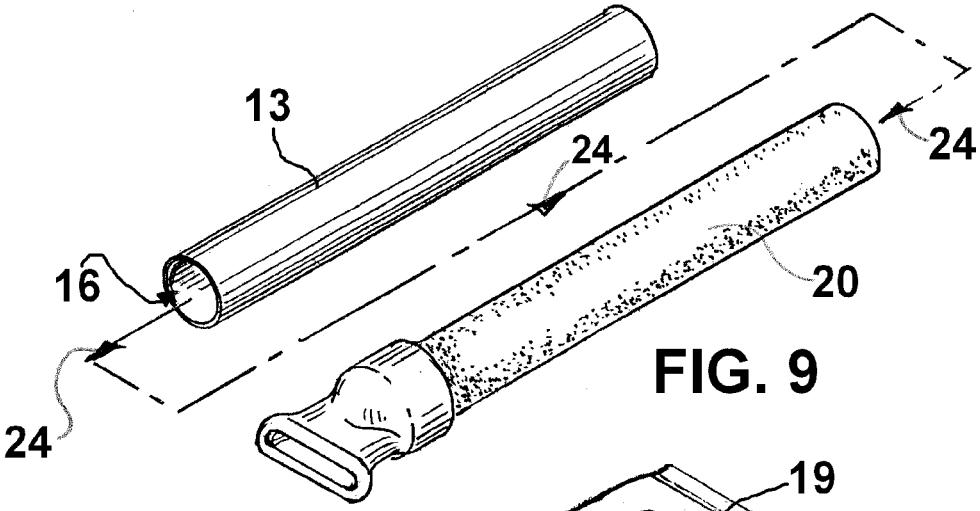
FIG. 9 is a perspective view of a kit embodiment incorporating the shell of FIG. 2 with the form casing of FIG. 5 schematically indicating that the items are combined coaxially and packaged for sale.

FIGS. 1 thru 4 show a preferred embodiment of the apparatus of the present invention designated generally by the numeral 10 in FIGS. 1-4. In FIGS. 1 thru 4, a shell or roll 20 can be provided that is one or more sheets of tobacco material or of tobacco and other material.

For example, the shell 20 can provide a first sheet 11 which is a tobacco sheet. However, the shell 20 could be formed of a laminate of a tobacco sheet as a first sheet 11 and a second sheet 12. Second sheet 12 could be a cellulose sheet or a tobacco sheet or other sheet. These sheets 11 and 12 can be laminated together or separable from each other.

In one embodiment first or exterior sheet 11 can be detachably connected to interior sheet 12 such that exterior sheet 11 can be peeled off of second or interior sheet 12.

In the embodiment of FIGS. 1 thru 4, shell 20 can include a first end portion 18 and a second end portion 19. The first end portion 18 can be closed. The second end portion 19 can be open. In this fashion, shell 20 can provide a cavity, bore or void space 16 that can be filled with a user's selected custom tobacco filler 15.

The first end portion 18 can be closed in any number of ways such as for example with a mouthpiece 21, end cap or plug 500 or 600, or a hemispherically shaped end 22 which is simply an extension of the sheet or sheets 11, 12.

Alternatively, as shown in FIG. 3 a plug or insert 23 can be provided which completely or partially closes the first end portion 18 of the shell 20. Plug 23 can be compacted tobacco material. Plug 23 can be a filter material such as cigarette filter material used in conventional cigarette. Plug 23 could also be a detachably connected cap end, internal mouthpiece, or other structural member that is not of tobacco material which supports and substantially closes off one end of shell 20.

In one embodiment shell 20 can have an overall longitudinal length $L_t$ and a longitudinal length $L_o$ of the cavity, bore, or void space 16. The difference between these two lengths can be the longitudinal length of plug 23. In various embodiments $L_o$ is about 1, 2, 3, 4, 5, 6, 7, 8, 9, 10, 15, 20, 30, 35, 40, 45, 49, and/or 50 percent of the length of $L_t$. In various embodiments the ratio is about between any two of the above specified percentages.

In various of the embodiments it is preferred that the closed end (first end portion 18) can be held by a consumer while placing tobacco filler material of choice in the cavity, bore, or void space 16 thru second end portion 19. In a preferred embodiment a funnel 700 can be provided which assists in the adding of tobacco filler material 15 of choice to cavity, bore, or void space 16. In this manner the consumer can prepare a custom made cigar, cigarillo, or cigarette.

The area in between mouthpiece 21 and second end portion 19 of shell 20 can be filled with a user's custom selected tobacco filler 15. Similarly in FIG. 2, the area in between the hemispherical end 22 (which is a closed end of shell 20) and the second end portion 19 would be filled with a tobacco filler 15 supplied by an end user. Likewise in FIG. 3, the area in between plug 23 and second end portion 19 of shell 20 would be filled with a tobacco filler 15 of a user's custom tobacco material. In the sectional view of FIG. 4, the shell 20 could be of a single layer or sheet 11 of tobacco material or a laminate that included a first sheet 11 of tobacco material and a second sheet 12 (or other sheets) of material that could be tobacco or not tobacco such as a cellulose sheet.

Figure 10:
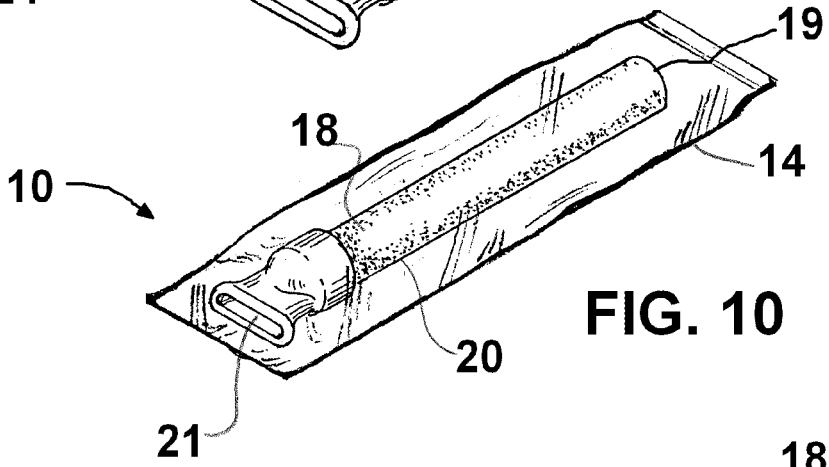
FIG. 10 is a perspective view of a packaged for sale version of the embodiment shown in FIG. 9.

In FIG. 10, smoking article 10 shown in FIG. 1, 2 or 3 could be packaged in a partially filled or unfilled condition within package 14 as shown. Package 14 could be a film or foil vacuum packed container or other container used to package shell 20 and wherein shell 20 is closed at end portion 18 with mouthpiece 21, hemispherical end 22, or plug 23.

FIGS. 5 and 7 illustrate a form casing 13 that could be used to reinforce the bore, void space or cavity 16 of shell 20. Form casing 13 can be generally cylindrically shaped, providing an internal bore 17. In FIG. 9, shell 20 is shown being supplied with form casing 13 as a reinforcement to its bore/space/cavity 16 as indicated schematically by arrows 24 in FIG. 9. It should be understood that in FIG. 10, shell 20 could be reinforced with form casing 13 of FIG. 9 and then packaged within package 14 as shown.

FIGS. 6 and 8 show a rod 24 that could be used to load and/or compact tobacco filler material 15 that is added by an end user to the bore/space/cavity 16 of shell 20. Rod 24 could be a hollow rod having one or more closed end portions 25, 26. Either end portion 25 or 26 could be used to load and/or compact tobacco filler material 15 into the bore/space/cavity 16 of shell 20. Rod 24 could also be a solid material such as wood or plastic as indicated schematically in FIG. 8.

FIG. 12 illustrates that shell 20, when fitted with either mouthpiece 21 or hemispherical end 22 or insert plug 23 could be reinforced with both form casing 13 and rod 24. In such a situation, rod 24 could be placed inside form casing 13, thus occupying its bore 17 as illustrated by arrows 27 in FIG. 12. The combination of form casing 13 and rod 24 could then be placed within the bore/space/cavity 16 of shell 20 as shown in FIG. 13. Arrows 28 in FIG. 12 schematically illustrate the placement of a combination of form casing 13 and rod 24 into the bore/space/cavity 16 of shell 20. Rod 24 is first placed in form casing 13. Form casing 13 (with rod 24 inside) is then placed into the void space/cavity/bore 16 of shell 20.

Figure 11:
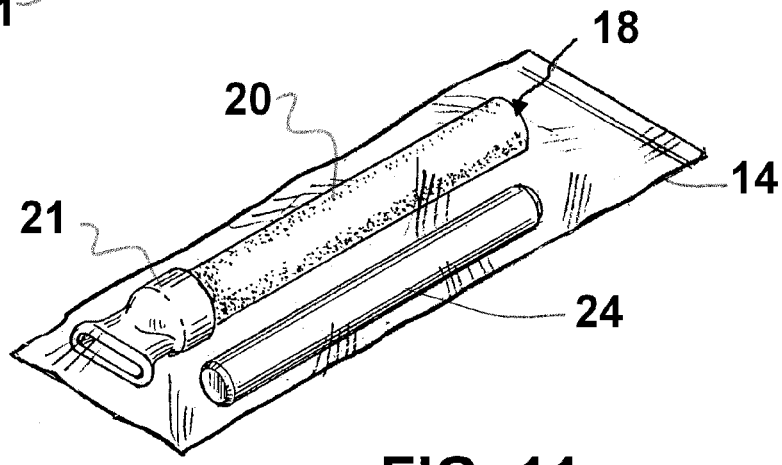
FIG. 11 is a packaged for sale version of the embodiment shown in FIG. 9 with the addition of the packaging or loading rod of FIG. 6 on the side of the combined shell and form casing of FIG. 9.

FIG. 14 illustrates that shell 20 could be reinforced with rod 24 alone and without using form casing 13. In FIGS. 14 and 15, rod 24 occupies the bore/space/cavity 16 of shell 20. In FIG. 10, the shell 20 shown could be empty, namely without form casing 13 or rod 24. Alternatively, FIG. 10 could represent shell 20 being reinforced by form casing 13. Further, FIG. 10 could represent shell 20 being reinforced with rod 24 alone. FIG. 11 illustrates that rod 24 could be placed in a package 14 next to shell 20. In such a situation, the bore/space/cavity 16 of shell 20 could either be empty, or reinforced with form casing 13.

The Figures show form casing 13 being placed in the interior of shell 20. However, shell 20 can be placed in the interior of form casing 13. In either manner form casing 13 can provide support and resist crushing of shell 20 before ultimate use by a consumer.

Figure 16:
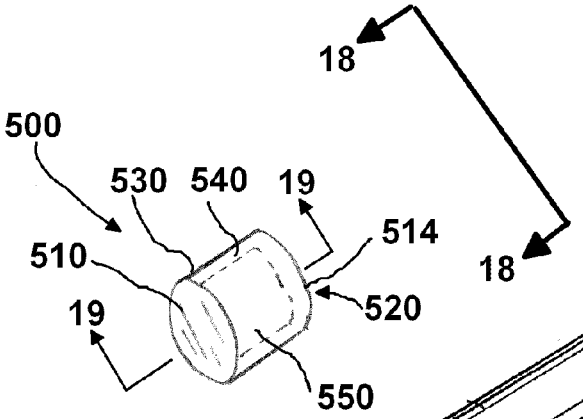
FIG. 16 is a perspective view of one embodiment of an end plug with an annular space for accepting a shell.
Figure 17:
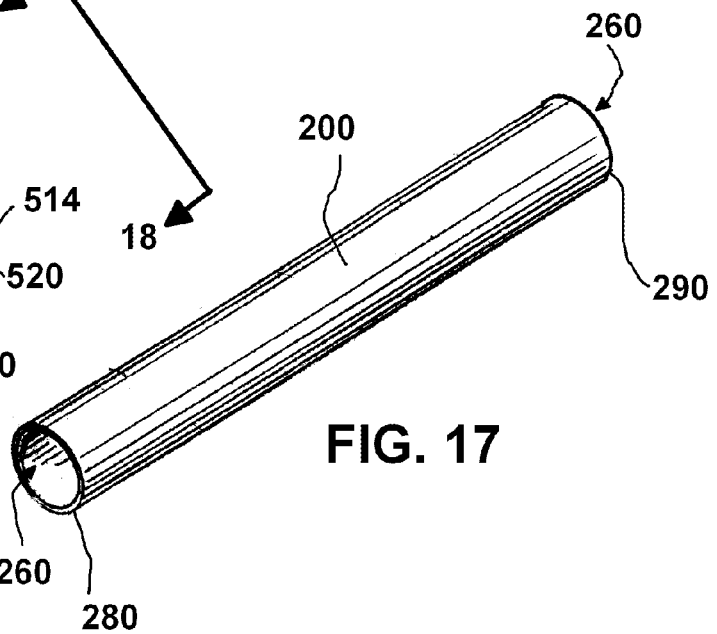
FIG. 17 is a perspective view of a shell which can be combined with the end plug of FIG. 16.

FIG. 16 is a perspective view of one embodiment of an end plug 500 with an annular space 540 for accepting a shell 200. FIG. 17 is a perspective view of a shell 200 which can be combined with end plug 500. End plug 500 can include first end portion 510, second end portion 514, side wall 530, and interior prong 550. End plug 500 can have annular space 540 which is the annular space between interior prong 550 and side wall 530.

Figure 18:
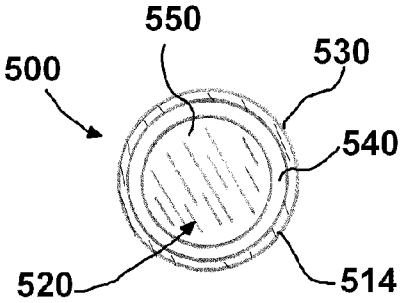
FIG. 18 is a side view of the end plug of FIG. 16 taken along the lines 18-18 of FIG. 16.
Figure 19:
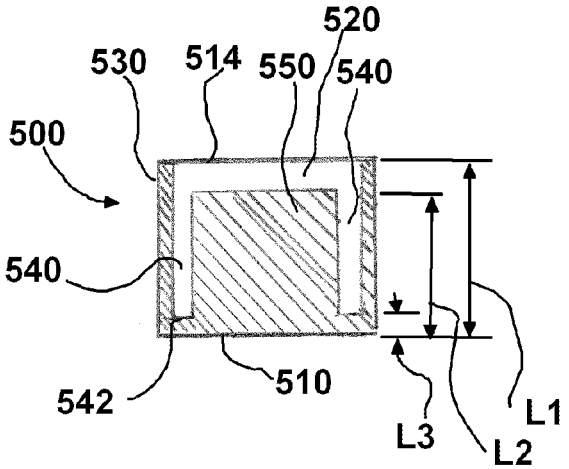
FIG. 19 is a side view of the end plug of FIG. 16 taken along the lines 19-19 of FIG. 16.

FIG. 18 is a side view of end plug 500 taken along the lines 18-18 of FIG. 16. FIG. 19 is a side view of end plug 500 taken along the lines 19-19 of FIG. 16. End plug 500 can have an interior volume 520 which is the space between second end portion 514 and the tip of interior prong 550. End plug can have a length L1. Interior prong 550 can have a length L2. L2 can be less than L1 causing there to be an interior volume 520. In an alternative embodiment L2 can be greater than L1 causing interior prong to actually stick out from end plug 500. L3 is controlled by the depth of annular space 540.

Figure 20:
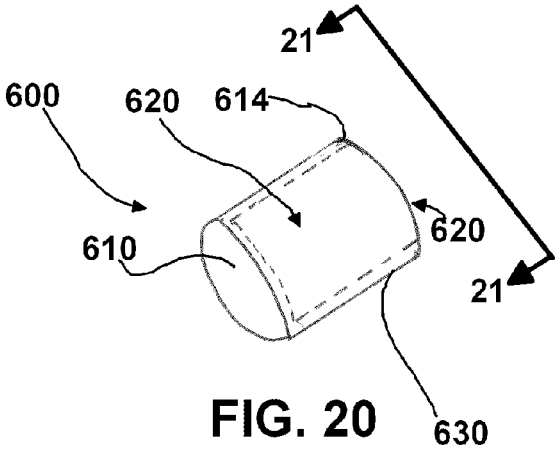
FIG. 20 is a perspective view of another embodiment of an end plug with an open cavity for accepting a shell.
Figure 21:
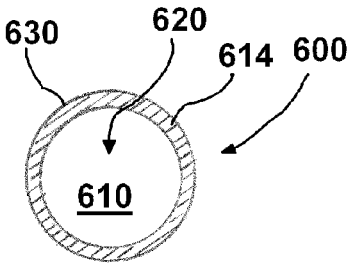
FIG. 21 is a side view of the plug of Figure taken along the lines 21-21 of FIG. 20.

FIG. 20 is a perspective view of another embodiment of an end plug 600 with an open cavity 600 for accepting a shell 200. FIG. 21 is a side view of plug 600 taken along the lines 21-21 of FIG. 20. End plug 600 can include first end portion 610, second end portion 614, side wall 630, and interior cavity 620. Interior cavity can accept shell 200.

Figure 22:
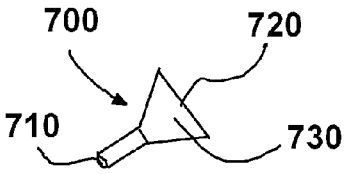
FIG. 22 is a perspective view of a funnel which can be included with any of the embodiments disclosed.

FIG. 22 is a perspective view of a funnel 700 which can be included with any of the embodiments disclosed. Funnel 700 can include first end 710, second end 720, and enlarged conical section 730.

Figure 23:
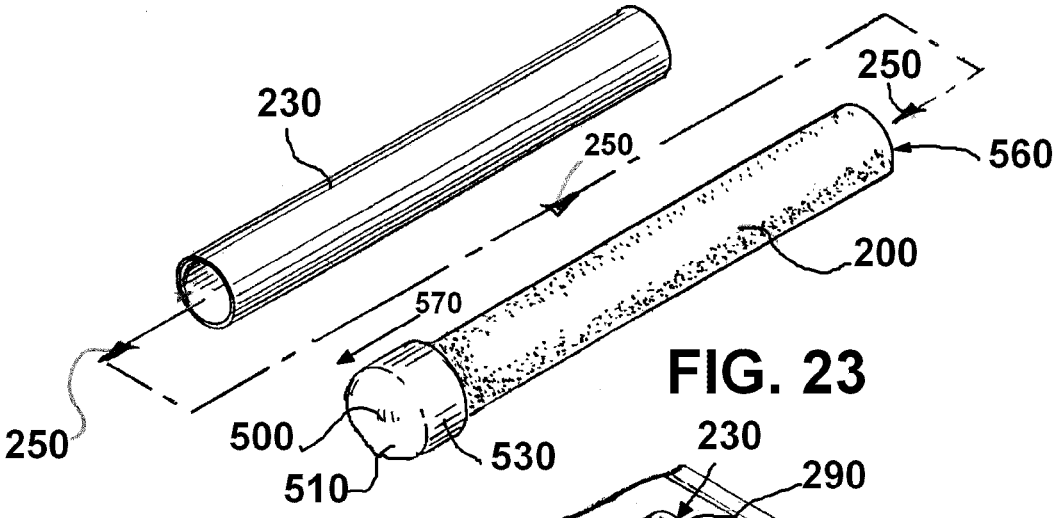
FIG. 23 is a perspective view of a kit embodiment incorporating the shell of FIG. 2 with the end plug of FIG. 16 or FIG. 20, and the form casing of FIG. 5 schematically indicating that the items can be combined in coaxial relationship and packaged for sale as a kit.
Figure 24:
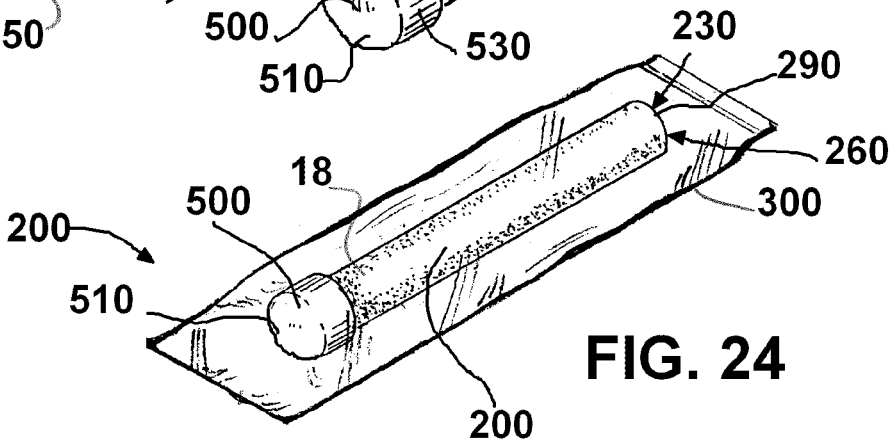
FIG. 24 is a perspective view of a packaged for sale version of the embodiment shown in FIG. 23.

FIG. 23 is a perspective view of a kit embodiment incorporating shell 200 with either end plug 500 or 600, and form casing 230 with arrows 250 schematically indicating that the items 230, 200, and 500/600 can be combined in coaxial relationship and packaged for sale as a kit. FIG. 24 is a perspective view of a packaged for sale version of the embodiment shown in FIG. 23.

Figure 25:
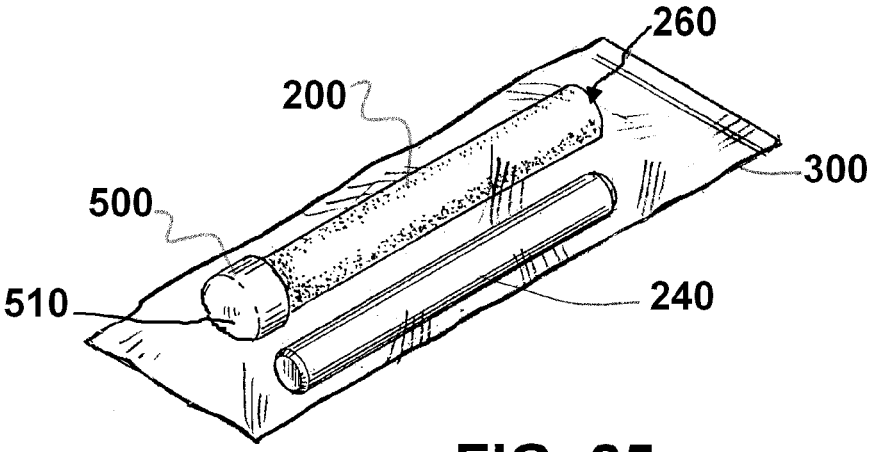
FIG. 25 is a packaged for sale version of the embodiment shown in FIG. 23 with the addition of the packaging or loading rod of FIG. 6 on the side of the combined shell and form casing of FIG. 23.

FIG. 25 is a packaged for sale version of the embodiment shown in FIG. 23 with the addition of the packaging or loading rod 240 on the side of the combined shell 200 and form casing 230. Packing or loading rod 240 can be combined in a coaxial relationship by being slid in the interior cavity of shell 200. And the interior of form casing 230. Form casing can be slid into shell 200, or shell 200 slid into form casing 230. Alternatively, packing or loading rod 240 can be slid into the interior of shell 200 and form casing 230 omitted. Where form casing 230 is omitted, packing or loading rod 240 can take the place of form casing 230. In this manner packing or loading rod 240 can closely follow the interior diameter of shell 200 (similar to that shown in FIG. 14).

Figure 26:
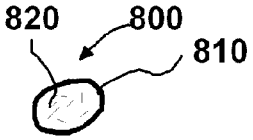
FIG. 26 is a schematic view of a flavoring insert which can be included in any of the embodiments.

FIG. 26 is a schematic view of a flavoring insert 800 which can be included in any of the embodiments. Flavoring insert 800 can comprise a breakable outer wall 810 with flavoring 820 on the inside. Breakable outer wall 810 can be various materials which are relatively sealing, along with being safe and easily broken when desired. For example, plastic, silicone, cellophane, or polymers. Before being broken the outer wall 810 should seal the flavoring product 820 on the interior of insert 800. Here, the flavoring material 820 can be any flavoring and/or scenting material using to flavor tobacco products. One or more inserts 800, 800', 800", etc. can be placed in plug 23 of shell 20 on first end 18. In FIG. 26 insert 800 is shown as being egg shaped. However, insert 800 can be a variety of shapes such as oblong, rectangular, spherical, etc. Liquid flavoring/scenting is preferred but a solid or gaseous flavoring/scenting can be used.

Figure 27:
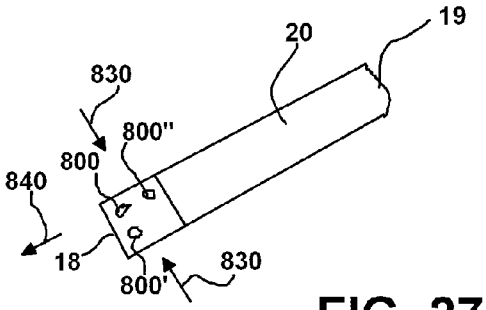
FIG. 27 shows a plurality of inserts placed in a plug.

FIG. 27 shows various inserts 800, 800', 800" located in a plug 23 of a shell 20. When flavoring is desired plug 23 can be squeezed (schematically indicated by arrows 830) causing the outer walls 810 of the flavoring inserts to break and release flavoring 820. Because the inserts 800 are located in plug 23 the consumer will taste and smell this flavor as such end 18 of shell 20 will be placed inside the mouth of the consumer when smoked. Additionally the direction of smoke flow will be in the direction of arrow 840 causing the smoke flowing past the released flavoring 820 to pick up such flavoring.

Figure 28:
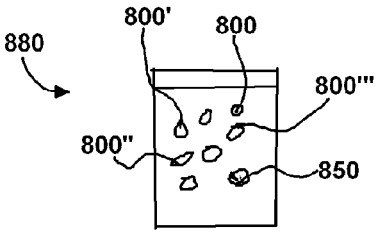
FIG. 28 shows a package containing a plurality of inserts.

FIG. 28 shows a package containing a plurality of flavoring inserts 800, 800', 800", etc. Instead of placing one or more flavoring inserts into plug 23, a flavoring packaging 880 can be providing which includes one or more flavoring inserts 800, 800', etc. In this embodiment the consumer can choose whether and how many inserts are placed in the finished tobacco product. The kit would include instructions directing the consumer to place selected inserts into the cigar, cigarette, and cigarillo. The instructions could also tell the consumer to squeeze the tobacco product to cause the inserts to release the flavoring.

In one embodiment the flavoring packaging 880 could include a plurality of inserts 800 with a plurality of different flavoring and/or scents. In one embodiment the different flavored and/or scented inserts could include flavor/scenting indicia. For example, the inserts could be color coded (e.g., purple for grape flavoring, red for cherry, etc.). As another example, the name of the flavor/scent can be imprinted on the insert. As another example a unique identifier could be placed on the insert and a table of flavoring included with the kit. With different flavors/scents for the various inserts, the consumer now would have the choice to customize the flavor along with customize the tobacco filler material for the finished tobacco product. As another example, more than one insert of the same flavor could be included allowing the consumer to increase the strength of the flavor/scent by insert two or more of the same flavored/scented inserts.

Method of Use

In one embodiment is provided a method and apparatus of making a custom cigar including the steps of:

(1) providing a shell for forming the cigar;
(2) the shell including two ends, one end being open and the second end being closed; the shell being packaged for sale in at least a partially unfilled condition;
(3) removing the shell from the packaging;
(4) filling the shell with a tobacco filler material of choice for form a custom cigar.

In one embodiment the shell is supported by a form casing. In one embodiment the form casing is coaxially located in the interior of the shell. In one embodiment the shell is coaxially located in the interior of the form casing.

In one embodiment a packing or loading rod can be used to support the shell. In one embodiment the packing or loading be coaxially located in interior of the form casing which form casing is coaxially located in interior of the shell. In one embodiment the packing or loading rod can be coaxially located in interior of the shell which shell is coaxially located in interior of the form casing. In one embodiment the packing or loading rod can also serve as the form casing and be coaxially located in the interior of the shell.

In one embodiment the shell can comprise a cylindrical tube of smokable material.

In one embodiment the shell can include at least one sheet of pre-rolled material that is removable from the remainder of the shell and can be used to roll a custom cigar, cigarillo, and/or cigarette.

In one embodiment the closed end of the shell can include a plug of tobacco which closes one end of the shell.

In one embodiment the closed end of the shell can include an end cap which closes one end of the shell. In one embodiment the end cap can include an annular space which detachably connects to the shell. In one embodiment the end cap can include an cavity which detachably connects with the shell.

In one embodiment the kit includes a funnel to assist in adding tobacco to the interior of the shell. In one embodiment the funnel is packaged with the kit. In one embodiment tobacco filler material is added to the shell using the funnel.

In one embodiment the shell is removed from the packaging and held by the closed end. In one embodiment the closed end provides structural support to the shell. In one embodiment the closed end the consumer fills the shell with tobacco filler material from the open end while supporting shell from the closed end.

In one embodiment the consumer uses a packing or loading rod to push in tobacco filler material into the interior of the shell. In one embodiment, the kit is removed from the packaging and the packing or loading rod is removed from the interior of the shell and the packing or loading rod is used to push in tobacco filler material into the interior of the shell.

In one embodiment, the kit is removed from the packaging, the shell is removed from a form casing, and tobacco filler material is placed in the interior of the shell. In one embodiment the shell is located in the interior of a form casing, while in another embodiment the form casing is located in the interior of the shell. In one embodiment a packing or loading rod is removed from the interior of the shell, and the packing or loading rod is used to push in tobacco filler material into the interior of the shell.

In one embodiment, after filling the interior of the shell with tobacco filler material, the closed end of the shell is opened. In one embodiment the closed end of the shell is opened by removing the end cap. In one embodiment, where the end cap includes an annular space, after the end cap is removed the shell is twisted closed by the end that was closed by the end cap.

In one embodiment is provided an edible mouth piece. In one embodiment the edible mouth piece is flavored. In one embodiment it is unflavored. In one embodiment the mouth piece is menthol flavored.

The following is a list of Reference Numerals used in this application along with a description of the reference numerals.

LIST OF REFERENCE NUMERALS

| Reference Number | Description |
|---|---|
| 10 | smoking article |
| 11 | tobacco sheet (first sheet) |
| 12 | cellulose sheet (second sheet) |
| 13 | form casing |
| 14 | package |
| 15 | tobacco filler |
| 16 | bore/space/cavity |
| 17 | bore |
| 18 | first end portion |
| 19 | second end portion |
| 20 | shell |
| 21 | mouthpiece |
| 22 | hemispherical end |
| 23 | plug |
| 24 | rod |
| 25 | end portion |
| 26 | end portion |
| 27 | arrow |
| 28 | arrow |
| 200 | smokable shell |
| 230 | form casing |
| 250 | arrows |
| 260 | bore/space/cavity |
| 280 | first end portion |
| 290 | second end portion |
| 300 | packaging |
| 500 | tube holder |
| 510 | first end portion |
| 514 | second end portion |
| 520 | interior volume |
| 530 | outer surface |
| 540 | annular space |
| 550 | interior prong |
| 560 | arrow |
| 570 | arrow |
| 600 | tube holder |
| 610 | first end portion |
| 614 | second end portion |
| 620 | interior volume |
| 630 | outer surface |
| 700 | funnel |
| 710 | first end |
| 720 | second end |
| 730 | enlarged conical section |
| 800 | insert |
| 810 | outer wall |
| 820 | flavoring/scenting interior |
| 830 | arrows |
| 840 | arrow |
| 850 | indicia |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A tobacco article, comprising:

(a) a sheet of material that provides a tubular shell having first and second ends, and a tube cavity that enables containment of tobacco filler material, the sheet being comprised of smokable material;

(b) a plug of material that at least partially closes the first end of the shell wherein the plug is removable from the tubular shell and once removed no longer at least partially closes the cavity, the plug having interior and exterior portions, the interior portion at least partially located in the interior of the tube cavity, and the exterior portion at least partially located outside of the interior of the tube cavity;

(c) a removable form casing at least partly inserted in the tube cavity to reinforce the tube cavity:

(d) a sale package that contains the sheet, the form casing and the plug, wherein the form casing occupies at least a part of the cavity; and (e) wherein while in the sale package, the tube cavity being unfilled with tobacco filler material from the second end of the tubular shell to the plug.

2. The tobacco article of claim 1, wherein the plug does not completely seal one end portion of the cavity.

3. The tobacco article of claim 1, wherein the plug completely seals one end portion of the cavity, but is removable from the tubular shell and once removed no longer at least partially blocks the cavity, and wherein the plug includes an annular space in which annular space the tubular shell is partially inserted to completely seal one end portion of the cavity.

4. The tobacco article of claim 1, further comprising a compacting tool that occupies the cavity enabling a compacting of tobacco into the cavity.

5. A tobacco article, comprising (a) a first sheet that is a laminate of a first layer that includes a first smokable material and a second layer of a second smokable material, the first smokable material being different from the second smokable material;

(b) a removable form casing:

(c) wherein the laminate is flexible and is wrapped around the form casing and rolled into a generally tubular form having a cavity, the form casing reinforcing the cavity;

(d) wherein an outer one of the layers is sealed so that it cannot be unrolled without damaging it;

(e) a plug that at least partially closes one end of the tubular form; and (f) a sale package that contains the sheets, the plug and form casing.

6. The tobacco article of claim 5, wherein a layer includes tobacco leaf material.

7. The tobacco article of claim 5, wherein a layer includes homogenized tobacco material.

8. The tobacco article of claim 5, wherein the package that envelops the laminate is sealed to prevent substantial escape of material.

9. The tobacco article of claim 5, wherein the plug is a mouthpiece.

10. The tobacco article of claim 5, wherein the plug does not completely seal one end portion of the cavity.

11. A tobacco article, comprising:

(a) a sheet that includes tobacco material formed in an elongated shell having a cavity;

(b) a plug that at least partially closes the cavity at one end portion of the shell;

(c) wherein the sheet is flexible and rolled into a generally tubular form;

(d) a removable form casing at least partly inserted in the cavity to reinforce the cavity:

(e) a rod that enables a user to compress tobacco placed in the cavity;

(f) a sale package that contains the layer, plug and rod; and (g) wherein while in the sale package, the cavity is unfilled with a tobacco filler.

12. The tobacco article of claim 11, wherein the layer is tobacco leaf material.

13. The tobacco article of claim 11, wherein the layer is of homogenized tobacco material.

14. The tobacco article of claim 12, wherein the layer is entirely of tobacco material.

15. The tobacco article of claim 12, wherein the layer is entirely of tobacco leaf material.

16. The tobacco article of claim 11, further comprising a second layer that forms a laminate with the first layer.

17. The tobacco article of claim 12, wherein the plug is a mouthpiece.

18. The tobacco article of claim 16, wherein the second layer does not contribute any flavor when it is smoked.

* * * * *